US009046244B2

(12) United States Patent
Yang

(10) Patent No.: US 9,046,244 B2
(45) Date of Patent: Jun. 2, 2015

(54) LIGHTING APPARATUS

(71) Applicant: Limin Yang, Zhejiang (CN)

(72) Inventor: Limin Yang, Zhejiang (CN)

( * ) Notice: Subject to any disclaimer, the term of this patent is extended or adjusted under 35 U.S.C. 154(b) by 304 days.

(21) Appl. No.: 13/669,386

(22) Filed: Nov. 5, 2012

(65) Prior Publication Data

US 2014/0085879 A1 Mar. 27, 2014

(30) Foreign Application Priority Data

Sep. 26, 2012 (CN) ..... 2012 1 0364298

(51) Int. Cl.

| | |
|---|---|
| ***F21V 7/09*** | (2006.01) |
| ***F21V 7/00*** | (2006.01) |
| ***F21V 23/04*** | (2006.01) |
| *F21S 9/02* | (2006.01) |
| *F21V 7/22* | (2006.01) |
| *F21Y 103/00* | (2006.01) |

(52) U.S. Cl.

CPC .. *F21V 7/09* (2013.01); *F21S 9/022* (2013.01); *F21V 7/005* (2013.01); *F21V 7/22* (2013.01); *F21V 23/0464* (2013.01); *F21Y 2103/00* (2013.01)

(58) Field of Classification Search

CPC ..... F21V 23/0442; F21V 23/0457; F21V 23/0464; F21V 7/005; F21V 7/09; F21V 7/22; F21S 9/022; F21Y 2103/00

See application file for complete search history.

(56) References Cited

U.S. PATENT DOCUMENTS

| | | | | |
|---|---|---|---|---|
| 5,782,552 | A * | 7/1998 | Green et al. | 362/183 |
| 7,490,957 | B2 * | 2/2009 | Leong et al. | 362/249.05 |
| 8,033,686 | B2 * | 10/2011 | Recker et al. | 362/249.02 |
| 8,415,901 | B2 * | 4/2013 | Recker et al. | 315/307 |

* cited by examiner

*Primary Examiner* — Thomas M Sember

(57) ABSTRACT

A lighting apparatus includes a lamp fixture; a bar-shaped lamp provided on the lamp fixture; a reflector, provided above the lamp fixture and below the bar-shaped lamp, including a first reflecting element, a second reflecting element opposite to the first reflecting element, and a reflector bottom connected to lower ends of the first and the second reflecting elements, so as to define a semi-closed internal space for containing the bar-shaped lamp, wherein the first and the second reflecting elements respectively have at least an outwardly-bent reflecting part for reflecting possibly much light out; a light sensor, clipping on the bar-shaped lamp, for detecting a change of ambient illuminance (LUX) and outputting a change signal; an electric power adjusting element, connected to the light sensor and the bar-shaped lamp, for receiving the change signal and accordingly adjusting the electric power of the bar-shaped lamp; and power connectors and emergency power connectors.

4 Claims, 18 Drawing Sheets

LIGHTING APPARATUS

BACKGROUND OF THE PRESENT INVENTION

1. Field of Invention

The present invention relates to a technology of an energy-saving lighting apparatus, related to a highly efficient reflector, a light sensor and technologies of power interface and emergency power interface.

2. Description of Related Arts

Energy-saving products on the market for converting T8/T12 types into T5 or LED type are realized by supplying power to lamps of T5 or LED through lamp fixtures of T8/T12, which requires a pre-modification to wiring of the T8/T12 lamps and further brings potential safety hazard and costs much labor.

Moreover, products on the market as a replacement of emergency lighting are mostly lamps having emergency ballasts and batteries provided inside, wherein the emergency lamps must reserve spots for installing the batteries, which means the installing and wiring of the batteries cause much trouble; besides, it is not environmentally friendly to leave the batteries unused.

Conventional reflectors used for bar-shaped lamps are mostly U-shaped to reflect light emitted from the lamps out to improve lighting efficiency; however, meanwhile much light is directly reflected onto the lamps by the U-shaped reflectors and this part of light is unused. The reflecting efficiency of the conventional reflectors has a great potential to be improved. As showed in FIG. 1, a conventional reflector of a bar-shaped lamp 4 has a cross section of a concave slot 6, wherein the concave slot 6 includes two slot arms and a slot bottom and the bar-shaped lamp 4 is provided above the slot bottom. Furthermore, for the conventional reflector, once the bar-shaped lamp is installed above the slot bottom, reflecting angles, an illuminating range and a focused range of light intensity thereof remain constant; and thus the lamp fails to have different illuminating angles and illuminating ranges required for different occasions and provide different light intensities in a certain range to make fullest use of light. Meanwhile when the conventional reflector has a gradually long service life, the reflecting efficiency of the conventional reflector gradually decreases because of piled dust, aged and peeled paints and etc. And the conventional reflectors are mostly fixedly shaped. In usual cases, the shape of the conventional reflector is unchangeable and the conventional reflector is an integrity allowing no disassembly, not to mention any recombination.

SUMMARY OF THE PRESENT INVENTION

An object of the present invention is to provide a lighting apparatus having a high reflecting efficiency, so as to efficiently reflect out light emitted from a bar-shaped lamp and improve an illuminating efficiency.

Another object of the present invention is to provide a lighting apparatus able to automatically adjust luminance, so as to save energy.

Another object of the present invention is to provide a modified lighting apparatus whose modification is safe and cheap.

Accordingly, in order to accomplish the above objects, the present invention provides a lighting apparatus including:

a lamp fixture;

a bar-shaped lamp provided above the lamp fixture;

a reflector provided above the lamp fixture and below the bar-shaped lamp, including a first reflecting element, a second reflecting element opposite to the first reflecting element and a reflector bottom connected to lower ends of the first reflecting element and the second reflecting element, so as to define a semi-closed internal space for containing the bar-shaped lamp, wherein the first reflecting element and the second reflecting element respectively have at least an outwardly-bent reflecting part for reflecting possibly much light out;

a light sensor, clipping on the bar-shaped lamp, for detecting a change of ambient illuminance (LUX) and converting the change into an electric signal;

an electric power adjusting element, connected to the light sensor and the bar-shaped lamp, for receiving the electric signal sent by the light sensor and accordingly adjusting the electric power of the bar-shaped lamp; and power connectors and emergency power connectors, respectively provided on the lamp fixture, respectively for electrifying the bar-shaped lamp and electrifying an emergency lamp.

The light sensor includes an intermediately closed middle part having two open ends and a light sensitive element provided therein, wherein a first open end is covered by a lid and a semi-ring clipper extended from a center of the lid for mounting the light sensor on the bar-shaped lamp; and a second open end has an adjusting knob sleeving on, wherein the adjusting knob has an open window whose openness enlarges gradually, for gradually increasing an amount of light which passes through the open window and radiates onto the light sensitive element, wherein the open window has a largest openness for the light sensitive element to be radiated by light to a greatest extent; when the adjusting knob is turned, the openness of the open window decreases to further decrease the radiated extent of the light sensitive element; when the adjusting knob is turned to wholly cover up the light sensitive element, the light sensitive element receives no light.

The open window has markings; each marking represents a sum of luminance of the lighting apparatus and the ambient illuminance, i.e., illuminance actually felt by users, for a convenience in adjusting the electric power of the lighting apparatus to satisfy illumination requirements.

The power connectors include a power wire having a plug and a power socket, wherein the plug matches the power socket. The power wire suits power sources of conventional lamps and is able to replace conventional power wires of the conventional lamps.

The emergency power connectors include a harness made of seven wires and an emergency power socket, wherein the harness has a plug at an end and the plug matches the emergency power socket.

These and other objectives, features, and advantages of the present invention will become apparent from the following detailed description, the accompanying drawings, and the appended claims.

DETAILED DESCRIPTION OF THE PREFERRED EMBODIMENT

Figure 9:
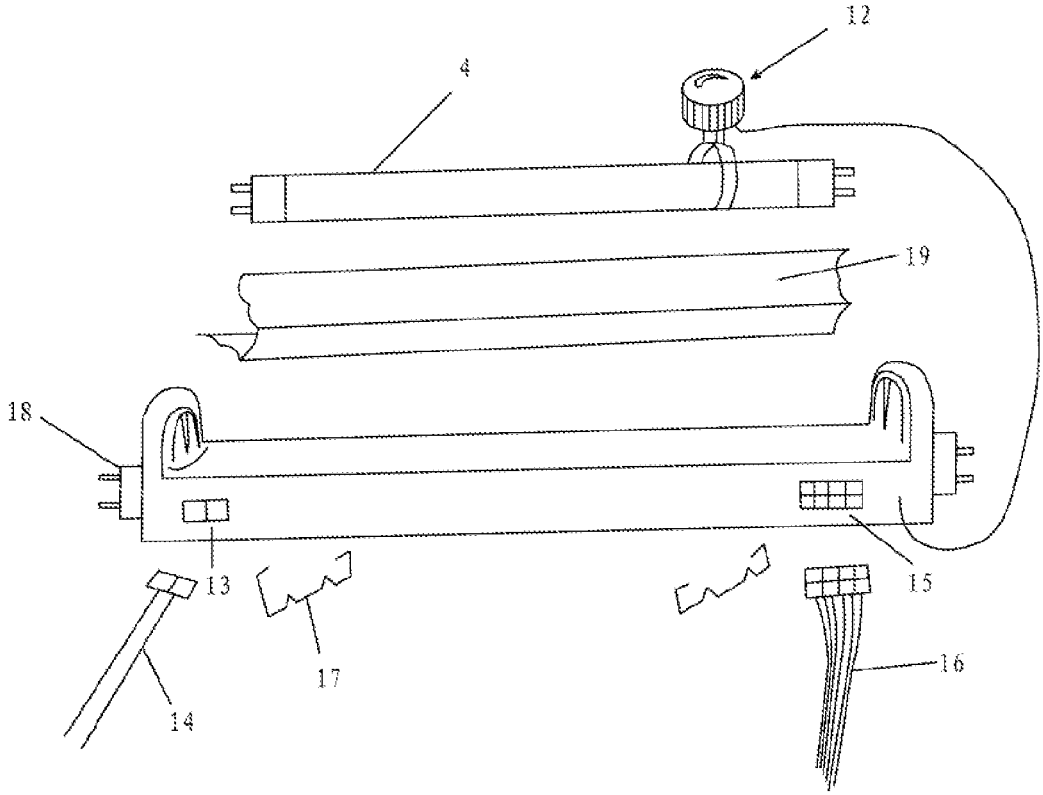
FIG. 9 is an exploded view of a lighting apparatus according to the preferred embodiment of the present invention.

Referring to FIG. 9 of the drawings, according to preferred embodiments of the present invention, a lighting apparatus includes a lamp fixture 18; a bar-shaped lamp 4 provided on the lamp fixture 18; a reflector 19, provided above the lamp fixture 18 and below the bar-shaped lamp 4, including a first reflecting element, a second reflecting element opposite to the first reflecting element and a reflector bottom connected to lower ends of the first reflecting element and the second reflecting element, so as to define a semi-closed internal space, for containing the bar-shaped lamp 4, wherein the first reflecting element and the second reflecting element respectively have at least an outwardly-bent reflecting part for reflecting light out possibly much; a light sensor 12, clipping on the bar-shaped lamp 4, for detecting a change of ambient illuminance (LUX) and sending out a change signal; an electric power adjusting element, connected to the light sensor 12 and the bar-shaped lamp 4, for receiving the change signal sent by the light sensor 12 and accordingly adjusting electric power of the bar-shaped lamp 4; and power connectors and emergency power connectors, respectively provided on the lamp fixture 18, respectively for electrifying the lighting apparatus and electrifying an emergency lamp.

Embodiment One

Figure 3:
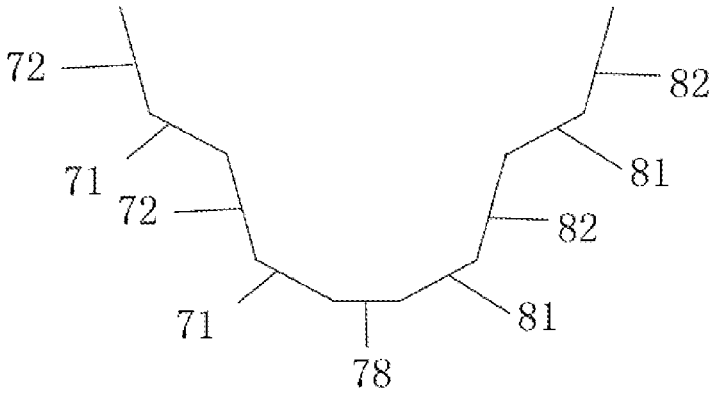
FIG. 3 is a sketch view of cross sections of two reflecting elements for being added of the reflector according to the first preferred embodiment of the present invention.

Referring to FIG. 3, according to a first preferred embodiment of the present invention, the reflector 19 includes a first reflecting element 7, a second reflecting element 8 opposite to the first reflecting element 7, and a reflector bottom 78 connected to lower ends of the first reflecting element 7 and the second reflecting element 8, so as to define a semi-closed internal space, for containing the bar-shaped lamp 4, wherein the first reflecting element 7 and the second reflecting 8 respectively have at least an outwardly-bent reflecting part for reflecting out light possibly much, so as to improve reflecting efficiency.

Preferably, the first reflecting element 7 has a first part 71 extending from the reflector bottom 78 and bending outwardly, for forming a first reflecting part and enlarging reflecting angles to reduce an amount of light reflected onto the bar-shaped lamp 4, and a second part 72 extending from the first part 71 and bending inwardly, for gathering and reflecting dispersed light onto effective region; the second reflecting element 8 has a first part 81 extending from the reflector bottom 78 and bending outwardly, for forming a second reflecting part and enlarging the reflecting angles to reduce the amount of light reflected onto the bar-shaped lamp 4, and a second part 82 extending from the first part 81 and bending inwardly, for gathering and reflecting the dispersed light onto the effective region; and the first reflecting element 7 and the second reflecting element 8 are opposite to each other.

Preferably, the first part 71 of the first reflecting element 7 and the first part 81 of the second reflecting element 8 both have an abrasive reflecting film covered thereon to prevent light from being directly reflected into human eyes, so as to avoid glare; and the second part 72 of the first reflecting element 7 and the second part 82 of the second reflecting element 8 both have a specular reflecting film covered thereon to reflect light onto the opposite reflecting element to further improve the reflecting efficiency.

Figure 2:
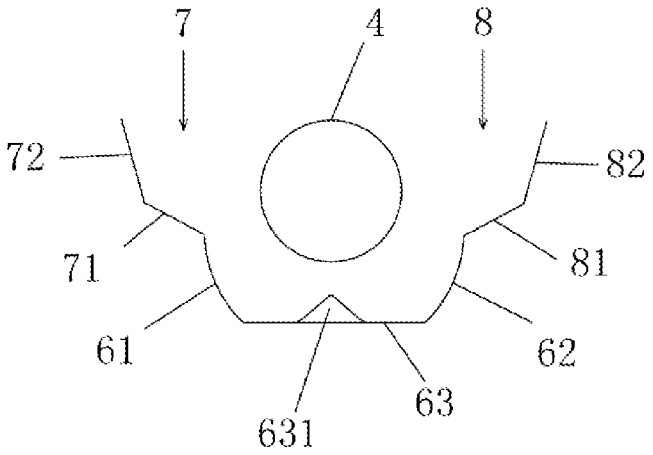
FIG. 2 is a sketch view of a cross section of a reflector installing on the conventional reflector of FIG. 1 according to a first preferred embodiment of the present invention.

Referring to FIG. 2, the reflector bottom 78 includes a concave slot 6, i.e., a conventional reflector according to prior arts, wherein the concave slot 6 includes a first slot arm 61, a second slot arm 62, and a slot bottom 63. The bar-shaped lamp 4 is provided above the slot bottom 63. The first reflecting element 7 and the second reflecting element 8 are respectively connected to the first slot arm 61 and the second slot arm 62.

The first reflecting element 7 and the first slot arm 61 are detachably connected; and the second reflecting element 8 and the second slot arm 62 are also detachably connected.

By the above structure, the reflector 19 functions as follows. The first part 71 of the first reflecting element 7 and the first part 81 of the second reflecting element 8 bend outwardly to enlarge the reflecting angles, so as to reduce the amount of light reflected onto the bar-shaped lamp 4; meanwhile the second part 72 of the first reflecting element 7 and the second part 82 of the second reflecting element 8 gather the dispersed light to improve illumination.

The reflector 19 further includes a reflecting prism 631 having a triangle cross section provided on a center of the slot bottom 63, for reflecting light emitted from the bar-shaped lamp 4 onto the first reflecting element 7 and the second reflecting element 8 to further improve the reflecting efficiency.

The first reflecting element 7 and the second reflecting element 8 are identical in shape and both have an obtusely V-shaped cross section.

The first reflecting element 7 has a reflecting material coating totally covering a V-shaped upper surface thereof; the second reflecting element 8 also has an identical reflecting material coating totally covering a V-shaped upper surface thereof. The two V-shaped upper surfaces are opposite to each other and exposed under the bar-shaped lamp 4.

According to the first preferred embodiment of the present invention, the reflector of the present invention can be realized by detachably installing the first reflecting element 7 and the second reflecting element 8 on the two slot arms of the common conventional reflector and exposing the two reflecting material coatings of the first reflecting element 7 and the second reflecting element 8 under the bar-shaped lamp 4.

FIG. 3 shows the first reflecting element 7 and the second reflecting element 8. If necessary, a plurality of the first reflecting elements 7 and a polarity of the second reflecting elements 8 can respectively be detachably added and connected to realize multi-layered reflection.

When the bar-shaped lamp 4 emits light, reflection path of the light emitted on the concave slot 6 stays unchanged; the reflection path of the light emitted on the first reflecting element 7 and the second reflecting element 8 are dispersedly reflected out. When the reflecting elements are broken because of the aged and peeled reflecting material coatings, the reflecting elements can be repaired by reflecting paints.

Obviously, compared to the prior arts, the present invention makes fuller use of light and improves light reflection effects; the present invention also can use the conventional reflectors to reduce cost and widen an application field; and the reflecting elements of the present invention can be flexibly assembled.

One skilled in the art will understand that, without obviously affecting the reflecting efficiency of the reflector, the first reflecting element 7 and the second reflecting element 8 according to the first preferred embodiment can have different shapes and be mutually replaced, which is within the present invention.

Embodiment Two

Figure 4:
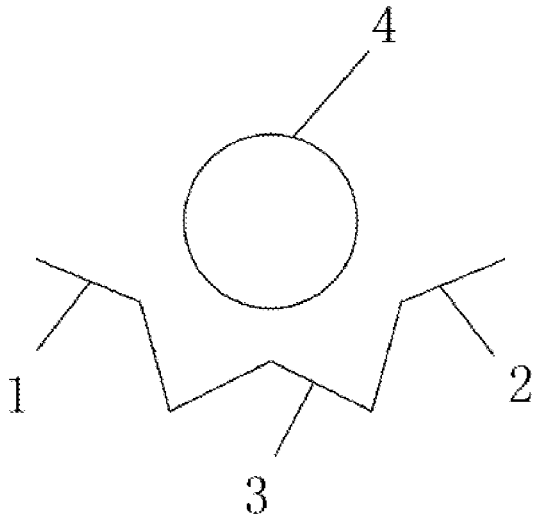
FIG. 4 is a sketch view of a cross section of the reflector according to a second preferred embodiment of the present invention.
Figure 5:
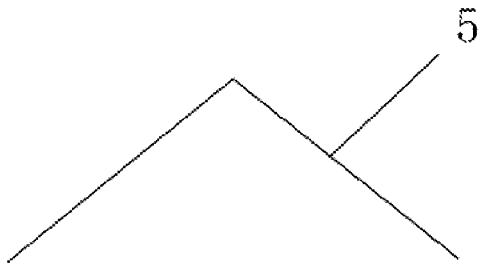
FIG. 5 is a sketch view of a cross section of reflecting material according to the second preferred embodiment of the present invention.

Referring to FIGS. 4 and 5, according to a second preferred embodiment of the present invention, the first reflecting element 7, the second reflecting element 8 and the reflector bottom 78 of the reflector 19 form a concave slot, wherein reflecting material 5 is provided thereon; the first reflecting element 7 forms a first slot arm 1; the second reflecting element 8 forms a second slot arm 2; the reflector bottom 78 forms a slot bottom 3; and 4 denotes the bar-shaped lamp.

The slot bottom 3 is respectively connected to the first slot arm 1 and the second slot arm 2, wherein the first slot arm 1 and the second slot arm 2 are opposite to each other. The bar-shaped lamp 4 is provided above the slot bottom 3. The first slot arm 1, the slot bottom 3 and the second slot arm 2 are identical in shape and connected successively.

The reflecting material 5 is provided on the slot arm or the slot bottom of the concave slot and exposed under the bar-shaped lamp 4; a shape of the reflecting material 5 accords with surfaces of the first slot arm 1, the second slot arm 2 and the slot bottom 3.

As showed in FIG. 5, the reflecting material 5 has an identical cross section with the first slot arm 1, the second slot arm 2 and the slot bottom 3. Thus, the reflecting material 5 accords with a surface of any part of the concave slot.

As showed in FIG. 4, the first slot arm 1, the second slot arm 2 and the slot bottom 3 all have a reflecting part bending outwardly and a cross section of an inverted and obtuse V-shape, wherein two sides thereof are identically long and a vertex thereof faces against the bar-shaped lamp 4.

Figure 1:
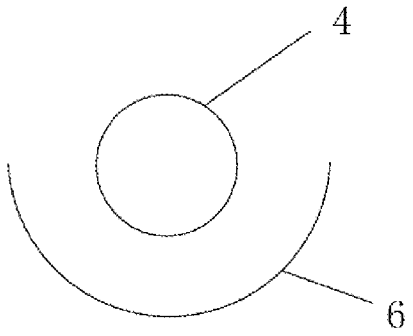
Fig. 1(prior art)
FIG. 1 is a sketch view of a cross section of a conventional reflector according to prior arts.

Compared to the conventional concave slot 6 as showed in FIG. 1, the slot bottom 3 is convex like a triangle, in such a manner that most received light can be reflected out instead of being reflected back onto the bar-shaped lamp 4, so as to improve usage of light source.

The first slot arm 1, the second slot arm 2 and the slot bottom 3 are detachably connected and can be easily installed because of the identical shape.

The reflecting material 5 is a reflecting plate which has a fixed shape and is detachably installed above the surfaces of the concave slot exposed under the bar-shaped lamp 4. The reflecting plate can be specular to produce good reflection, but may cause glare; or the reflecting plate can be abrasive to produce relatively poor reflection, but avoid the glare. Based on practical needs of working occasion, it is optional to decide whether or not to install the reflecting plate and an amount and specific positions of installing of the reflecting plate.

By the above structure, in order to provide high light, three specular reflecting plates 5 are respectively installed above the first slot arm 1, the second slot arm 2 and the slot bottom 3; the three specular reflecting plates 5 are exposed under the bar-shaped lamp 4. Light emitted from the bar-shaped lamp 4 is mostly reflected out of the reflector 19 by the three specular reflecting plates 5. The part bending outwardly of the first slot arm 1 and the part bending outwardly of the second slot arm 2 are for purposively reflecting light out. And the light emitted by the bar-shaped lamp 4 onto the slot bottom 3 is mostly reflected out of the reflector 19. By replacing the three specular reflecting plates 5 with three abrasive reflecting plates 5, the high light can be avoided.

According to the second preferred embodiment of the present invention, the reflector 19 of the present invention can be easily installed and has the reflecting efficiency obviously improved and reflecting effects adjusted based on practical needs, so as to satisfy different illumination requirements.

One skilled in the art will understand that in the second preferred embodiment of the present invention the slot arms and the slot bottom are identical in shape, which brings convenience in production, transportation and installing; without obviously affecting the reflecting efficiency and the reflecting effects, the slot arms and the slot bottom can have minor difference in shape and thus different correspondent reflecting materials, which is still within the present invention.

Embodiment Three

Figure 6:
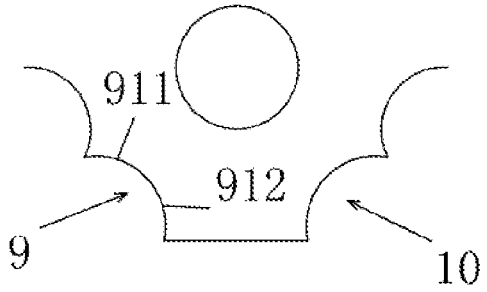
FIG. 6 is a sketch view of a cross section of the reflector according to a third preferred embodiment of the present invention.
Figure 7:
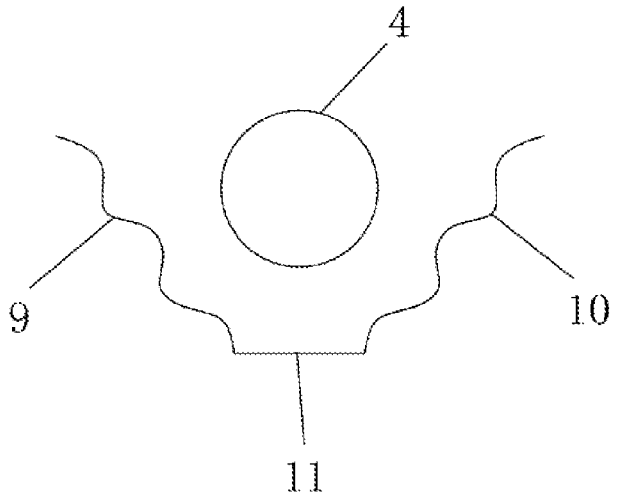
FIG. 7 is a sketch view of a first alternative mode of the reflector according to the third preferred embodiment of the present invention.

Referring to FIGS. 6-7, according to a third preferred embodiment of the present invention, the reflector 19 includes a concave slot and reflecting material, wherein the concave slot includes a first slot arm 9, a second slot arm 10 and a slot bottom 11, wherein the bar-shaped lamp 4 is provided above the slot bottom 11; and the reflecting material is a reflecting film covering a surface of the concave slot exposed under the bar-shaped lamp 4.

FIG. 6 shows a cross section of the first slot arm 9, including two arcs 91 which are serially connected and both bulge towards the bar-shaped lamp 4, wherein each arc 91 has an upper part 911 bending outwardly to define a reflecting part and enlarge reflecting angles, so as to reduce an amount of the light reflected onto the bar-shaped lamp 4, and a lower part 912 bending inwardly to gather and reflect dispersed light onto the surface of the opposite slot arm. The first slot arm 9 and the second slot arm 10 are symmetrical.

Further, as showed in FIG. 7, the first slot arm 9 and the second slot arm 10 can have a plurality of parts bending outwardly to be wavy, so as to improve reflecting effects.

The slot bottom 11 is flat.

The first slot arm 9 and the second slot arm 10 are totally covered by the reflecting film. The reflecting film can be specular, abrasive or a combination of specular films and abrasive films. The reflecting film has a shape identical with surfaces of the first slot arm 9 and the second slot arm 10.

The slot bottom 11 has a surface exposed under the bar-shaped lamp 4 and the surface of the slot bottom 11 is covered by a reflecting material coating, totally or partially.

By the above structure, during a working process of the reflector 19, a reflecting efficiency of the light emitted from the bar-shaped lamp 4 onto the slot bottom 11 is improved because of the reflecting material coating; the first slot arm 9 and the second slot arm 10 are able to reflect most of received light out because of the plurality of parts bending outwardly. A combination of the specular reflecting films and the abrasive reflecting films not only prevents glare from existing at some region where glare is forbidden, but also maintain illumination high enough.

Figure 15:
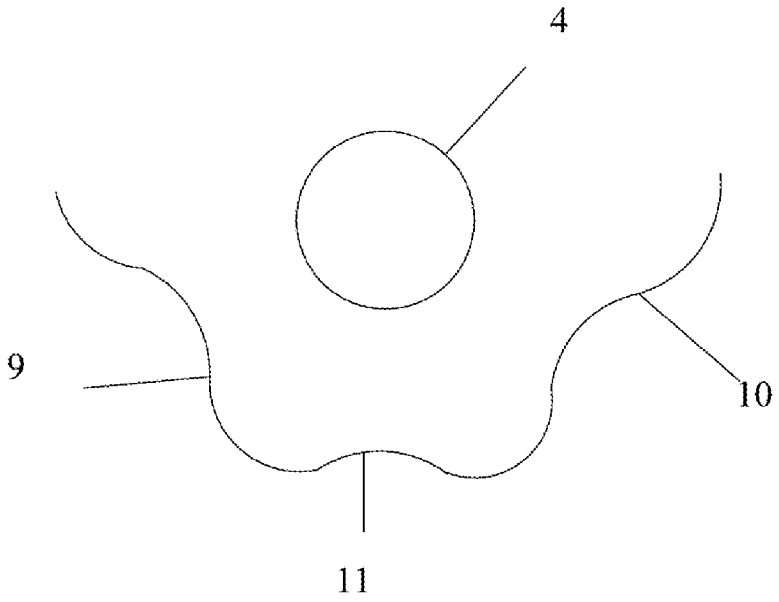
FIG. 15 is a sketch view of a fifth combination of the reflector and the bar-shaped lamp according to the preferred embodiment of the present invention.

FIG. 15 shows an alternative mode of the slot bottom 11, whose cross section is an arc bending towards the bar-shaped lamp 4. The slot bottom 11 is smoothly connected to the first slot arm 9 and the second slot arm 10 respectively, so as to form a continuous wave.

One skilled in the art will understand that the obtuse V-shape according to the first preferred embodiment and the second preferred embodiment produces good reflecting effects; without obviously affecting performance of the present invention, a V-shape of 90 degrees or other degrees is still within the present invention.

Referring to FIGS. 11, 12, 13 and 14, combinations of the bar-shaped lamp 4 and the reflector 19 are showed. As showed in FIG. 11, the reflector bottom of the reflector 19, the first reflecting element and the second reflecting element are identical in shape and have a cross section of an arc bent towards the bar-shaped lamp 4; and the bar-shaped lamp 4 is a fluorescent lamp provided on the reflector bottom of the reflector 19. As showed in FIG. 12, the reflector bottom of the reflector 19 has a cross section of an arc bent towards the bar-shaped lamp 4; the first reflecting element and the second reflecting element have an identical shape and both have a cross section of two arcs serially connected and bent towards the bar-shaped lamp 4; and the bar-shaped lamp 4 is a fluorescent lamp provided above the reflector bottom. As showed in FIG. 13, the reflector bottom of the reflector 19 is flat; the first reflecting element and the second reflecting element have an identical shape and a cross section of an arc bent towards the bar-shaped lamp 4; and the bar-shaped lamp 4 is an LED light bar provided in the reflector bottom. As showed in FIG. 14, the reflector bottom of the reflector 19 is flat; the first reflecting element and the second reflecting element have an identical shape and a cross section of two arcs serially connected and bent towards the bar-shaped lamp 4; and the bar-shaped lamp 4 is an LED light bar provided in the reflector bottom.

Figure 8:
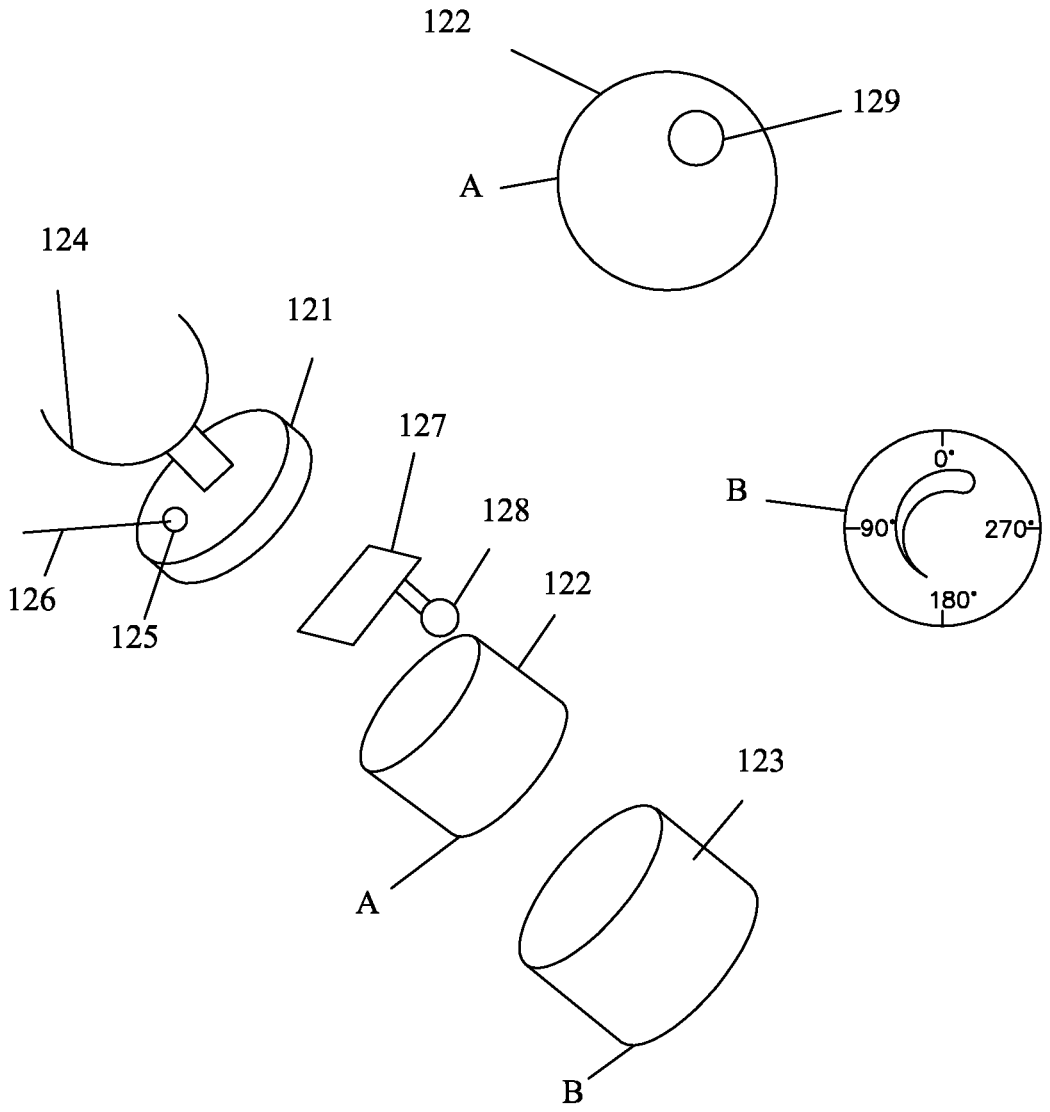
FIG. 8 is a perspective view of a light sensor according to a preferred embodiment of the present invention.

Referring to FIG. 8, according to a preferred embodiment of the present invention, the light sensor 12 includes a cylinder 122 including a hollow cylinder 129 parallel provided therein, a light sensitive diode 128 further provided inside the hollow cylinder 129 and a circuit board 127 connected to the light sensitive diode 128, wherein it is avoided to provide the hollow cylinder 129 at a central axis of the cylinder 122 and the cylinder 122 has a cross section of A; a round lid 121 having an opening 125 covers a first end of the cylinder 122 and a semi-ring clipper 124, for mounting the light sensor 12 on the bar-shaped lamp 4, extends from a center of the round lid 121, wherein a signal line 126 is connected to the circuit board 127 and passes through the opening 125 to be connected to the electric power adjusting element; a cylindrical adjusting knob 123 having only an end face, showed as B, is sleeved on a second end of the cylinder 122, wherein the end face B of the adjusting knob 123 has an arc-shaped open window whose openness is enlarged gradually, wherein the arc-shaped open window circles around a center of the end face B and is provided above the hollow cylinder 129; the largest openness of the arc-shaped open window is identical with a diameter of the hollow cylinder 129. Thus when the largest openness overlaps with the hollow cylinder 129, which means that the largest openness of the arc-shaped open window is positioned right above the hollow cylinder 129, a whole area of a cross section of the hollow cylinder 129 receives light, when the light sensitive diode 128 is exposed to light at a greatest range. Then when turning the adjusting knob 123, an openness of the arc-shaped open window right above the hollow cylinder 129 decreases gradually, in such a manner that the area of the cross section of the hollow cylinder 129 receiving light is reduced gradually and accordingly the range exposed to light of the light sensitive diode 128 is reduced gradually. When the openness of the arc-shaped open window right above the hollow cylinder 129 is zero, the hollow cylinder 129 is totally covered up and receives no light, so that the light sensitive diode 128 detects no light.

Preferably, the arc-shaped open window of the light sensor 12 has markings representing a sum of luminance of the lighting apparatus and ambient illuminance.

Figure 10A:
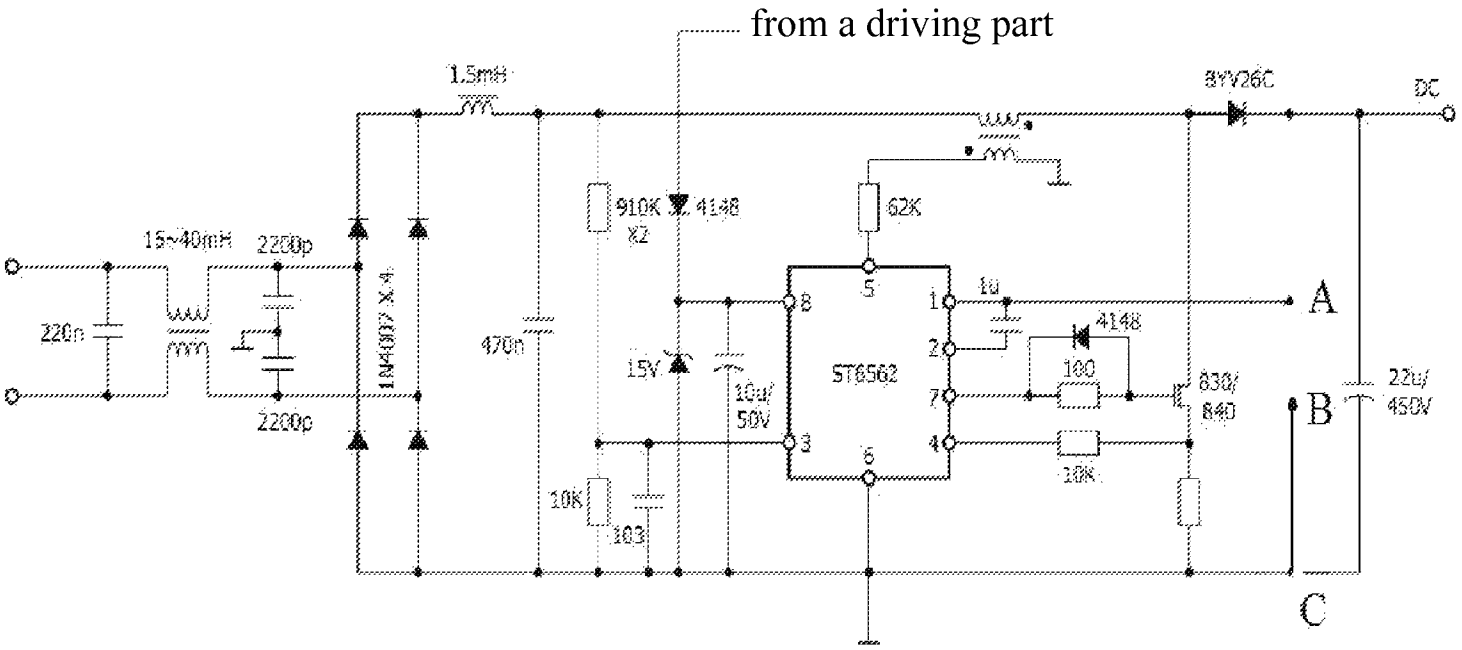
FIG. 10A is a sketch view of an electric power adjusting circuit according to the preferred embodiment of the present invention.

As showed in FIG. 10A, the electric power adjusting element is an electric power adjusting circuit, wherein point C is connected to a shield signal line.

For example, the lighting apparatus is installed at a height of 3 meters above ground; the light sensor 12 faces downwardly and the lighting apparatus is already electrified; supposing that the ground below the light sensor 12, or a working platform below the light sensor, has a illumination of 30 lux, the illumination is required by users to increase up to 60 lux. This is realized by turning the adjusting knob 123 to reduce the range exposed to light of the light sensitive diode 128 and then generating a light signal; and accordingly, the light sensitive diode 128 generates a current change and the light sensor 12 directly converts the current change into a voltage signal and outputs the voltage signal into the electric power adjusting circuit, so as to enlarge electric power of the bar-shaped lamp 4 until the illumination of the ground reaches 60 lux. By adjusting the openness of the arc-shaped open window of the light sensor 12, the electric power of the bar-shaped lamp 4 is changed until the illumination of the ground reaches 60 lux. Thereby, further, supposing that power of the bar-shaped lamp 4 is 18w, when the ambient illuminance increases because of natural light through windows or doors, or extra lamps being turned on, the light sensitive element detects the increasing of illuminance and accordingly generates a current change; and then the light sensor 12 directly coverts the current change into a voltage signal and outputs the voltage signal into the electric power adjusting circuit, in such a manner that the power the bar-shaped lamp 4 can be reduced to 10*w* to ensure that the illuminance of the ground remains at a level of 60 lux. Similarly, when the ambient illuminance decreases to 10 lux because of the weakened extra lamps, the power of the bar-shaped lamp 4 is adjusted to increases up to 26w, so as to ensure that the illuminance of the ground still remains at a level of 60 lux. Data of the bar-shaped lamp 4 in the above example includes 1200 mm, i.e., 4' or 4 feet, a voltage of 120V, and a power range of 6.8w to 30w. Specific numbers in the above example are based on virtual supposition, rather than reality.

Figure 10B:
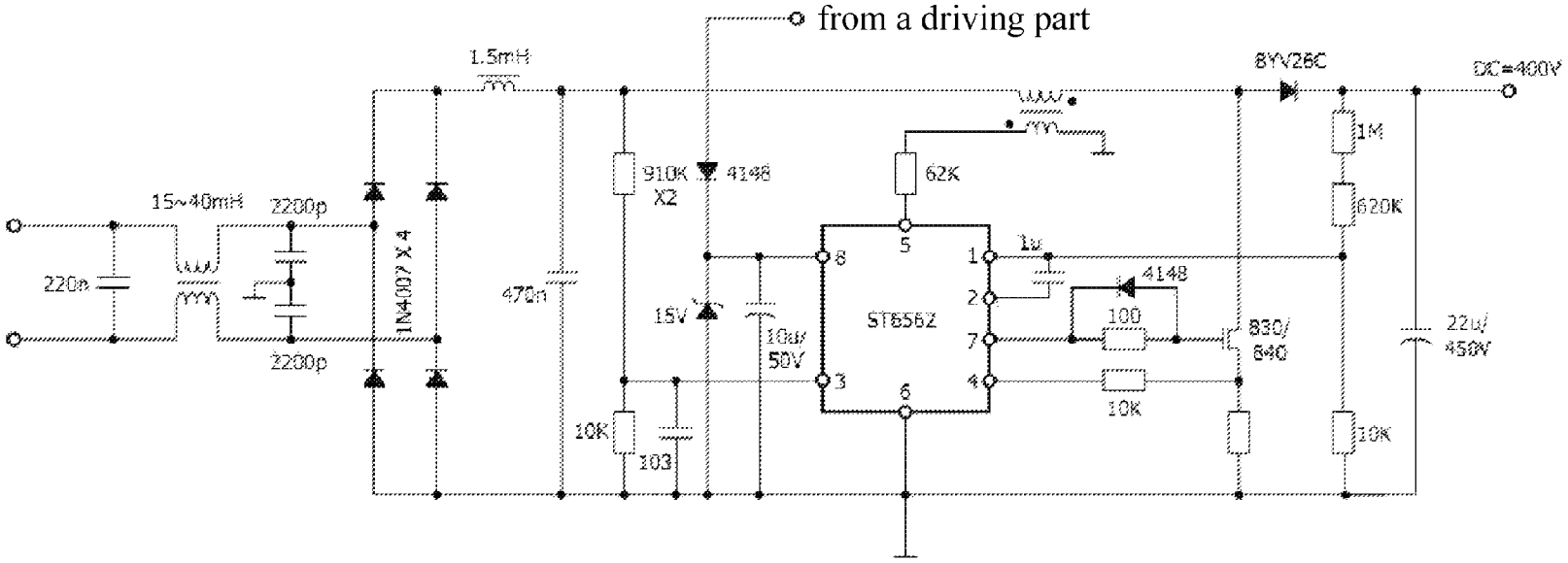
FIG. 10B is a sketch view of a first alternative mode of the electric power adjusting circuit according to the preferred embodiment of the present invention.

FIG. 10B shows a typical APFC (active power filter circuit) widely applied in conventional lamp circuits, wherein IC foot 1 keeps a stable output voltage via feedbacks of the output voltage. According to the preferred embodiment of the present invention, changing voltage signals are inputted into the foot 1 to accomplish power adjusting. Type of the IC as showed in FIG. 10B is L6562. Different factories produce different types of IC and accordingly different types of IC have different signal inputting feet.

As showed in FIG. 10A, the light sensor 12 coverts a light signal into a current signal via a light sensitive diode and further into a voltage signal via an internal circuit thereof and then outputs the voltage signal into IC foot 1.

Figure 10C:
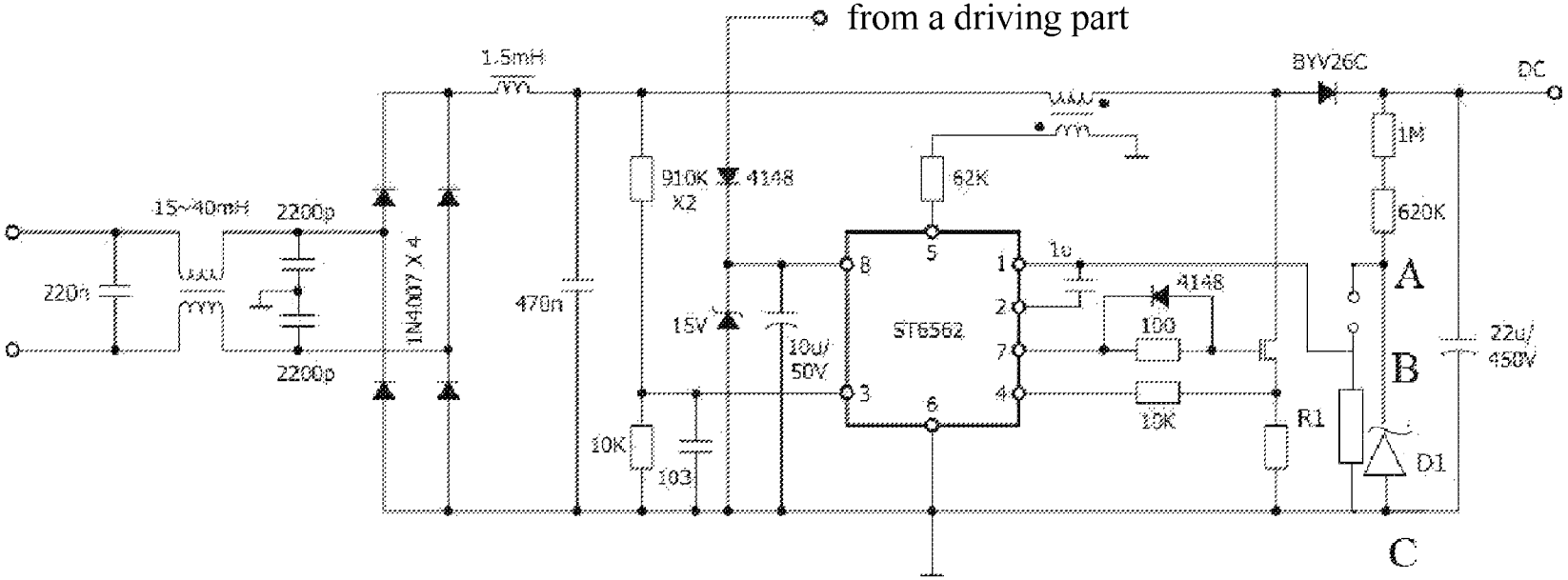
FIG. 10C is a sketch view of a second alternative mode of the electric power adjusting circuit according to the preferred embodiment of the present invention.
Figure 11:
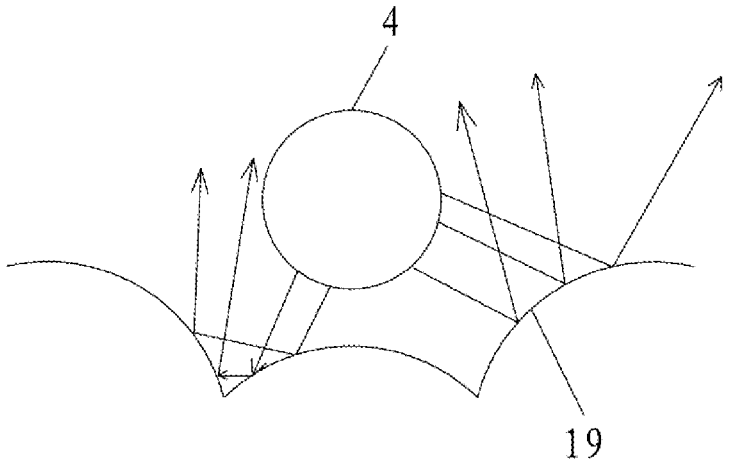
FIG. 11 is a sketch view of a first combination of the reflector and a bar-shaped lamp according to the preferred embodiment of the present invention.
Figure 12:
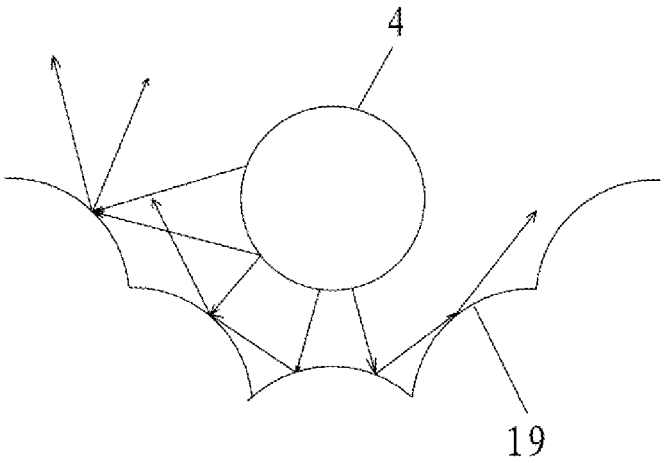
FIG. 12 is a sketch view of a second combination of the reflector and the bar-shaped lamp according to the preferred embodiment of the present invention.
Figure 13:
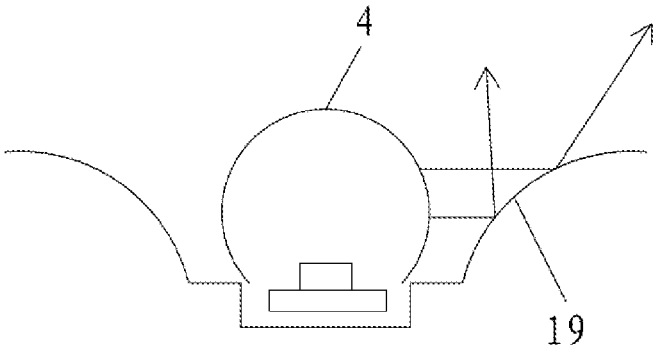
FIG. 13 is a sketch view of a third combination of the reflector and the bar-shaped lamp according to the preferred embodiment of the present invention.
Figure 14:
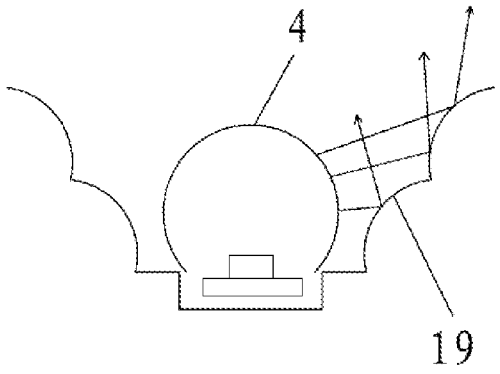
FIG. 14 is a sketch view of a fourth combination of the reflector and the bar-shaped lamp according to the preferred embodiment of the present invention.

As showed in FIG. 10C, the light sensitive element of the light sensor 12 is a light sensitive resistor whose resistance signal is converted into a voltage signal via R1 and D1 to be inputted into IC foot 1.

The light sensor 12 and the electric power adjusting circuit cooperate with each other to provide illumination required by users and save energy.

Referring to FIG. 9, the power connectors include a power socket 13 and a power wire 14 having a plug, wherein the plug matches the power socket 13; the emergency power connectors include an emergency power socket 15 and an emergency harness 16, wherein the emergency harness 16 has a plug at an end and the plug matches the emergency power socket 15.

Figure 16:
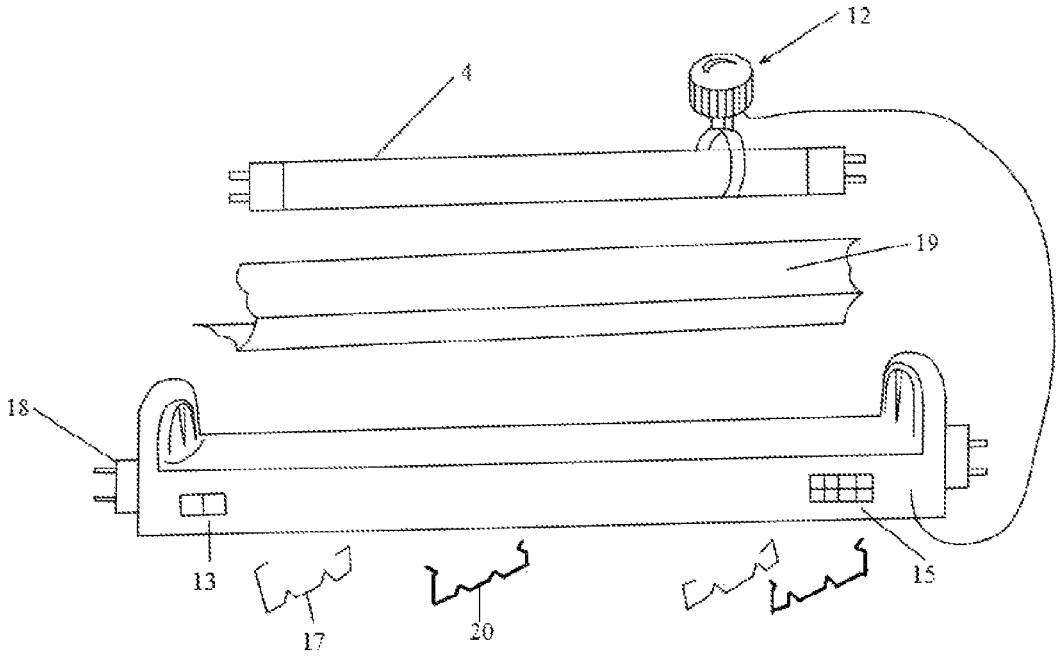
FIG. 16 is a sketch view of steel fasteners according to the preferred embodiment of the present invention.

According to a preferred embodiment of the present invention, the power connectors and the emergency power connectors of the lighting apparatus of the present invention can be realized based on a conventional T8/T12 as follows. Firstly, power of the T8/T12 to be modified is removed; then the power line 14 having the plug of the present invention is connected to power source; and finally the lighting apparatus of the present invention is installed on a G13 lamp fixture of the T8/T12 and the power line 14 is inserted into the power socket 13. Thereby, if the T8/T12 has an emergency lighting function, the T8/T12 is modified further as follows. Firstly, conventional power lines are removed; then two power lines and five wires of an emergency ballast and an emergency battery are accordingly connected to the emergency harness 16; and finally the lighting apparatus is installed on the G13 fixture of the T8/T12 and the emergency harness 16 is inserted into the emergency socket 15 of the lighting apparatus. The lighting apparatus of the present invention includes a connection of the emergency harness 16 and the emergency ballast of the modified T8/T12 and uses the emergency ballast and battery of T8/T12 to accomplish a function of emergency lighting and reduce cost, wherein especially the usage of the battery reduces pollution to environment. Preferably, as showed in FIG. 9, the lighting apparatus of the present invention further includes two installing fasteners 17 respectively provided at two ends of the reflector 19 for a replacement of the reflector 19. As showed in FIG. 16, when the lamp fixture of the conventional T8/T12 becomes aged or broken, the lighting apparatus further includes two steel fasteners 20 directly mounted at a bottom of the conventional T8/T12, for mounting the bar-shaped lamp 4.

The power connectors and the emergency power connectors of the present invention eliminates potential safety hazard and saves much labor.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighting apparatus, comprising a bar-shaped lamp and a reflector provided below said bar-shaped lamp, for reflecting out light of said bar-shaped lamp; and further comprising a light sensor provided on said bar-shaped lamp for detecting a change of ambient illumination and sending a change signal, and an electric power adjusting element connected to said light sensor and said bar-shaped lamp, for receiving said change signal and accordingly adjusting power of said bar-shaped lamp, wherein said light sensor comprises a middle part having two open ends and a closed intermediate part, wherein a light sensitive element is provided inside said middle part; a lid covering on a first end of said middle part and a semi-ring clipper extending from a center of said lid for mounting said light sensor on said bar-shaped lamp; and an adjusting knob sleeved on a second end of said middle part, wherein said adjusting knob has an open window whose openness enlarges gradually for gradually increasing an amount of light passing through said open window to radiate on said light sensitive element via turning said adjusting knob, wherein a largest openness of said open window is chosen to expose said light sensitive element under light to greatest extent.

2. The lighting apparatus, as recited in claim 1, further comprising a lamp fixture provided below said reflector and power connectors for electrifying said bar-shaped lamp, wherein said power connectors comprise a power socket provided on said lamp fixture of said lighting apparatus and a power line having a plug, wherein said plug matches said power socket.

3. The lighting apparatus, as recited in claim 2, further comprising an emergency lighting apparatus and an emergency power socket connected to said emergency lighting apparatus, wherein said emergency power socket comprises an emergency socket provided on said lamp fixture of said lighting apparatus and an emergency harness having a plug at an end thereof; said plug of said emergency harness matches said emergency socket; and a second end of said emergency harness is connected said emergency lighting apparatus.

4. A light sensor for a lighting apparatus, the lighting apparatus comprising a bar-shaped lamp, a reflector provided below the bar-shaped lamp for reflecting out light of the bar-shaped lamp, and an electric power adjusting element, wherein:

said light sensor is provided on the bar-shaped lamp for detecting a change of ambient illumination and sending a change signal, and the electric power adjusting element is connected to said light sensor and the bar-shaped lamp, for receiving said change signal and accordingly adjusting power of the bar-shaped lamp, wherein said light sensor comprises a middle part having two open ends and a closed intermediate part, wherein a light sensitive element is provided inside said middle part; a lid covering on a first end of said middle part and a semi-ring clipper extending from a center of said lid for mounting said light sensor on the bar-shaped lamp; and an adjusting knob sleeved on a second end of said middle part, wherein said adjusting knob has an open window whose openness enlarges gradually for gradually increasing an amount of light passing through said open window to radiate on said light sensitive element via turning said adjusting knob, wherein a largest openness of said open window is chosen to expose said light sensitive element under light to greatest extent.

* * * * *